US005232148A

United States Patent [19]

Vilas-Boas

[11] Patent Number: 5,232,148

[45] Date of Patent: Aug. 3, 1993

[54] PROTECTIVE WRAPPER FOR PACKAGING HEAVY PRODUCTS AND A METHOD FOR PACKAGING USING THE WRAPPER

[75] Inventor: Jean-Claude Vilas-Boas, Sannois, France

[73] Assignee: Bull S.A., Paris, France

[21] Appl. No.: 761,254

[22] Filed: Sep. 17, 1991

[30] Foreign Application Priority Data

Sep. 27, 1990 [FR] France ..... 90 11946

[51] Int. Cl.[5] ..... B65D 75/56

[52] U.S. Cl. ..... 229/87.04; 383/8; 383/17; 383/37; 383/67; 206/554; 206/594

[58] Field of Search ..... 383/6, 7, 8, 9, 10, 383/17, 22, 25, 37, 41, 43, 66, 67, 120, 121; 229/87.03, 87.04; 206/554, 583, 594

[56] References Cited

U.S. PATENT DOCUMENTS 4,759,446 7/1988 Dobashi et al. .

FOREIGN PATENT DOCUMENTS 0237977 9/1987 European Pat. Off. .

*Primary Examiner*—Stephen P. Garbe
*Assistant Examiner*—Jes F. Pascua
*Attorney, Agent, or Firm*—Weingarten, Schurgin, Gagnebin & Hayes

[57] ABSTRACT

A protective wrapper is provided that is especially well suited for packaging heavy products held by gripping elements during a packing phase. The protective wrapper is completely closed on three sides and is partially open on a fourth side that includes a passage means, e.g., a simple cut. The passage means makes it possible to first insert the product to be packaged into the wrapper while the product is held by a gripping element, and then to release the gripping element once the wrapper is in place around the product. The protective wrapper also includes a gripping means that facilitates extraction and holding of the wrapped product during its unpacking. A method for packaging that employs the wrapper is provided which can easily be automated.

3 Claims, 2 Drawing Sheets

PROTECTIVE WRAPPER FOR PACKAGING HEAVY PRODUCTS AND A METHOD FOR PACKAGING USING THE WRAPPER

FIELD OF THE INVENTION

This invention relates to protective wrappers for packaging heavy products, and particularly to a protective wrapper composed of a flexible plastic material, as well as to a method for packaging that employs the protective wrapper.

BACKGROUND OF THE INVENTION

Traditionally, products to be packaged, especially fragile and heavy products, are protected against impact by means of wedging systems before they are enclosed in wrapping or in crates. The wedging systems are generally made of blocks of polystyrene in the shape of wedges or half-shells of a certain rigidity to prevent direct transmission of impacts. When this type of package is shipped or handled, however, the packaged product is inevitably subjected to vibration and slight shifting and rubbing inside the wedging system, which has the effect of leaving markings and degrading the external appearance of the packaged product, by deterioration of the paint finish, for example. One means currently employed to eliminate this risk of degradation consists of surrounding the product with flexible plastic wrapping before adding the wedging system. The wrapper is then subject to rubbing and vibration, but because of its flexibility, it protects the product and prevents the it from suffering any marking or deterioration.

Nevertheless, use of a protective wrapper of this kind poses certain disadvantages. In particular, when a heavy product is being packaged, it is often suspended by a gripping element, for example an articulated sucker applied to the upper surface of the product, to facilitate handling during this operation. A first disadvantage becomes evident when the wrapper is slipped around the product and the gripping element interferes with the movement and closure of the wrapper. Then, when it is desired to remove the gripping element, the wrapper interferes with its movement. The packaging operation cannot be automated under these conditions, at least not during these latter two phases.

In addition, closure of such a wrapper is more difficult; once the product has been wrapped, it is then necessary to reclose the opening by means of adhesive tape, for example, which also entails lost time and consequently additional expense.

SUMMARY OF THE INVENTION

A protective wrapper is provided with considerable flexibility of use during a packing operation of a heavy product at a reasonable cost, the packing operation being easily automated. The protective wrapper includes a partially closed fourth side, a passage means for permitting the heavy product to be inserted into the wrapper while the product is held by a gripping element and for releasing the gripping element once the wrapper is around the product. In a preferred embodiment, the passage means includes a cut made starting at the bottom of the wrapper and extending through its entire thickness along a plane essentially orthogonal and median to the wrapper bottom, the cut extending for about three quarters of the length of the wrapper. The protective wrapper of the invention considerably facilitates insertion of the product into the wrapper, with all interference caused by the presence of the gripping element being eliminated by the passage means of the wrapper, the passage means also permitting convenient release of the gripping element. In addition, closure of the wrapper is facilitated because it assumes the shape of the product and because it is not necessary to reclose the opening using adhesive tape, resulting in saved time and a reduction of the cost of the packing operation.

To prevent shifting inside a packing box, wedging systems are commonly provided so that once the product has been protected, it can slide without play into the packing box. However, when the box is to be unpacked, the product must be delicately extracted when the product is unpacked, since the product is then wedged against the inside of the packing box and access is rendered increasingly difficult as the filling ratio (ratio by volume of the container to the contents) is optimized. The protective wrapper of the invention facilitates this unpacking operation considerably. The protective wrapper also includes, as an extension of its fourth side, a gripping means for extracting and/or holding the wrapped product. In a preferred embodiment, the gripping means includes a strip of material cut out from the extension of the wrapper over a central portion of the width of its fourth side, the strip being closed at the end furthest from the fourth side of the wrapper, thereby forming a loop that makes it possible to extract and/or to grip the wrapped product. A human hand, or any other extracting means, can thus be passed into the interior of the loop, thereby ensuring extraction or retention of the wrapped product in a simple and effective manner. Thus, the unpacking operation is facilitated, with the gripping means permitting extraction and gripping of the wrapped product without difficulty. The gripping means can further include a stiffened part that ensures balanced distribution of the pulling and stretching forces over the total width of the gripping means. The stiffened part can be produced by welding the strip as an extension of the wrapper along two symmetrical segments, each having as its origin one edge of the closed end of the strip and as its end a common point located on the median axis of the strip, thereby providing an even more solid gripping means that effectively resists pulling or stretching forces so that the symmetry and shape of the stiffened part ensure judicious distribution of the forces. Depending on the nature of the symmetrical segments (linear or curved), different shapes can be created, e.g., a V-shape or a U-shape, when the gripping means includes a strip cut out from the extension of the wrapper, or very simply a handle, including a grip for example, which would be welded on as an extension of the fourth side of the wrapper.

The protective wrapper of the invention can be used advantageously in a method for packaging wherein a heavy product is held by a gripping element, the method including the steps of: spreading apart two ends of the bottom by a passage means and presenting the wrapper thus opened to receive the heavy product; engaging and sliding the wrapper around the heavy product until it covers it completely; applying a wedging system to the resulting wrapped product; inserting the wrapped product, in conjunction with the wedging system, into a wrapper; and releasing the gripping element which is then free to traverse the passage means. This method can be executed either manually or automatically.

DESCRIPTION OF THE DRAWING

The invention will be more fully understood from the following detailed description, in conjunction with the accompanying figures, in which.

DETAILED DESCRIPTION OF THE INVENTION

Figure 1:
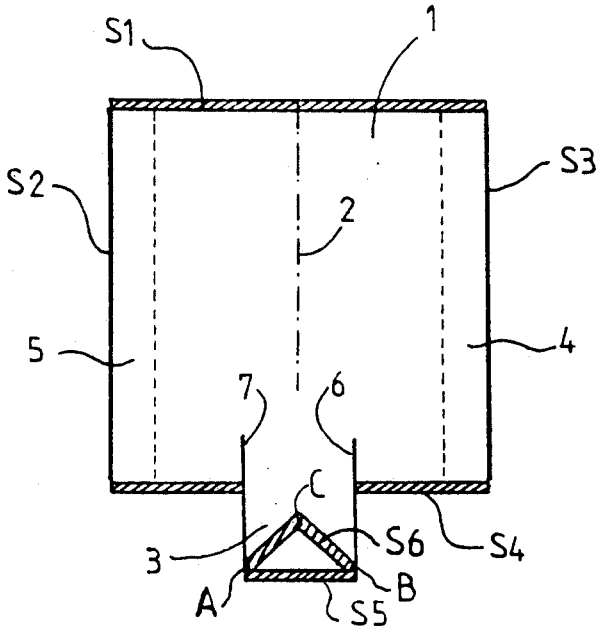
FIG. 1 is a top view of an embodiment of a protective wrapper of the invention.

With reference to FIG. 1, a top view of an embodiment of a protective wrapper 1 for packaging heavy products is shown. The wrapper 1 includes a flexible plastic material forming a pocket of an essentially rectangular shape closed on three of its four sides, bottom S1 and the two side parts S2 and S3.

According to the invention, the fourth side S4 is partially closed while, starting at bottom S1, a passage means 2 is provided for allowing insertion of the product to be packaged into the wrapper 1 while the product is held by a gripping element (see FIGS. 4A and 4B), and also for allowing release of the gripping element once the wrapper is around the product.

In the present embodiment, passage means 2 is a cut made starting at the bottom S1 of the wrapper and extending through its complete thickness along a plane essentially orthogonal and median to the wrapper bottom and, as shown in the example of FIG. 1, extending for approximately three quarters of the length of the wrapper.

The protective wrapper also includes as an extension of its fourth side S4, a gripping means 3 for extracting and/or holding a wrapped product thus packaged.

Gripping means 3 includes a strip of material cut from the extension of wrapper 1 over central portion of the width of its fourth side S4. The strip is closed at its end S5 furthest from fourth side S4, thus forming a loop that serves as a handle, thereby making it possible to extract the wrapped product from its packing and/or to hold it.

In a practical fashion, the protective wrapper can advantageously be mass-produced starting with a flattened flexible plastic tube and preferably forming a bellows on each of its lateral parts, each wrapper being cut to length in the desired shape and closed by welding at predetermined points.

The tube material used to make the protective wrapper can be transparent polyethylene, for example, whose thickness must be chosen as a function of the weight of the product to be wrapped.

Figure 2:
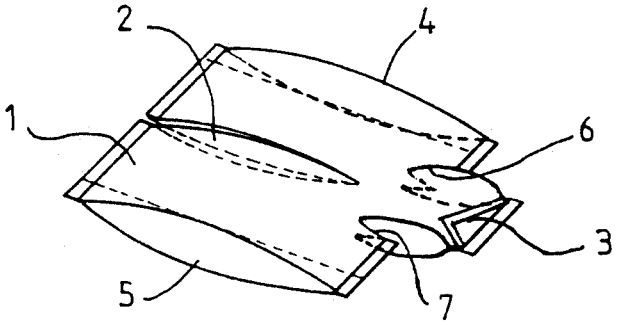
FIG. 2 is a perspective view of the protective wrapper of FIG. 1.

Referring to FIGS. 1 and 2, the flattened tube with its two lateral bellows 4 and 5 is cut to the desired length and shape (a pocket with an extension). Bottom S1, the part not extended from side S4, as well as end S5 of gripping means 3 are welded and the cut for passage means 2 is made. At the same time, stiffened part S6 of the gripping means can be produced by welding along two symmetrical weld line segments each having as its origin an edge (A, B) of closed end (S5) of the strip and as its end, a common point C located on the median axis of the strip. In the embodiment proposed, the two symmetrical weld line segments are linear and thus produce a stiffened part S6 in the form of an inverted V. Welded surfaces S1, S4, S5, and S6 are shown as narrow shaded regions in FIG. 1. Likewise, to obtain a loop of sufficient size once the wrapper is intimately disposed around the product, two short cuts 6 and 7 are advantageously made in the extension of gripping means 3 and running toward the interior of the protective wrapper. The cuts 2, 6, and 7 are shown as dot-dashed lines in the drawing.

Figure 3:
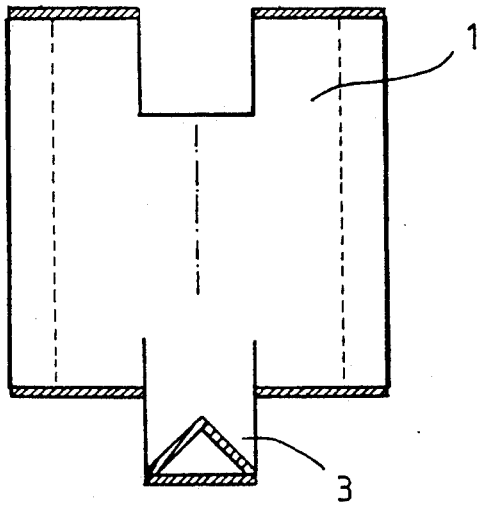
FIG. 3 is a top view of an alternate embodiment of the protective wrapper of the invention.

FIG. 3 shows a variation on wrapper 1 that can advantageously be mass-produced, with gripping means 3 of each wrapper then being cut in the bottom of the previous wrapper. As a result, there will be no loss of material, and the cost of a wrapper can then be further reduced.

FIG. 4 illustrates four stages (4A, 4B, 4C, 4D) of a packaging process using protective wrapper 1 according to the invention (stiffened part S6 is not shown). The product 10 to be packaged in these four stages is gripped by a gripping element 11 applied to the upper surface of the product. The gripping element 11 is preferably articulated so as to orient and shift the heavy product easily.

Figure 4A:
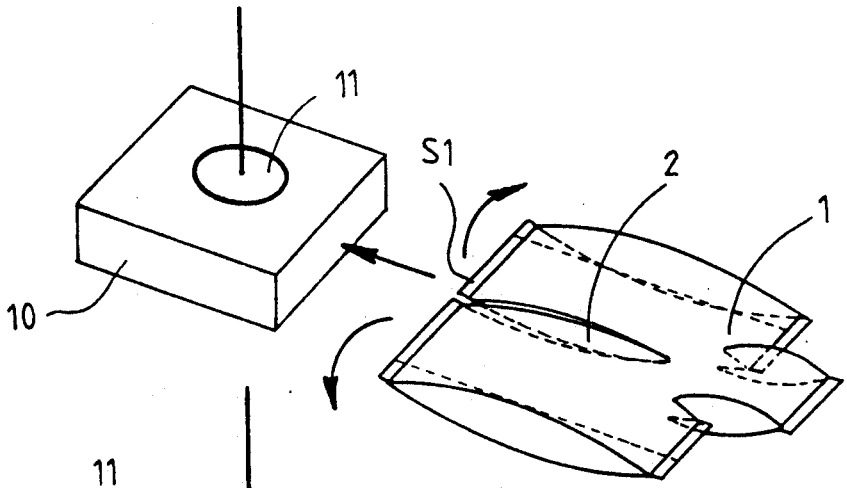
FIGS. 4*a*–4*d* are a schematic representation of a method for using the protective wrapper of the invention, the method including four steps.

FIG. 4A represents the presentation of the wrapper. The two ends of bottom S1 are located on either side of passage means 2, thus opening the wrapper which is presented to cover product 10.

Figure 4B:
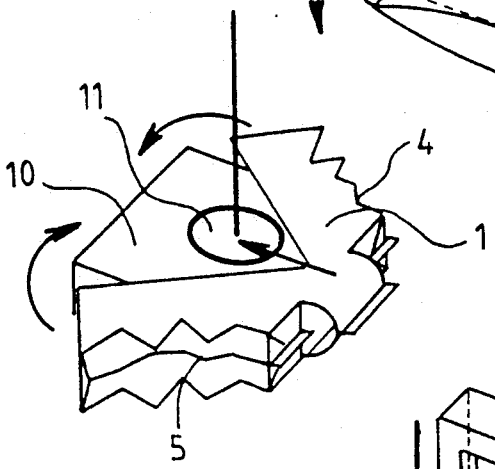

In FIG. 4B, wrapper 1 is engaged and then slides around the product 10 until it is covered completely without having been blocked by gripping element 11. Expansion of bellows 4 and 5 allows the wrapper to assume the shape of the product 10 to be packaged.

Figure 4C:
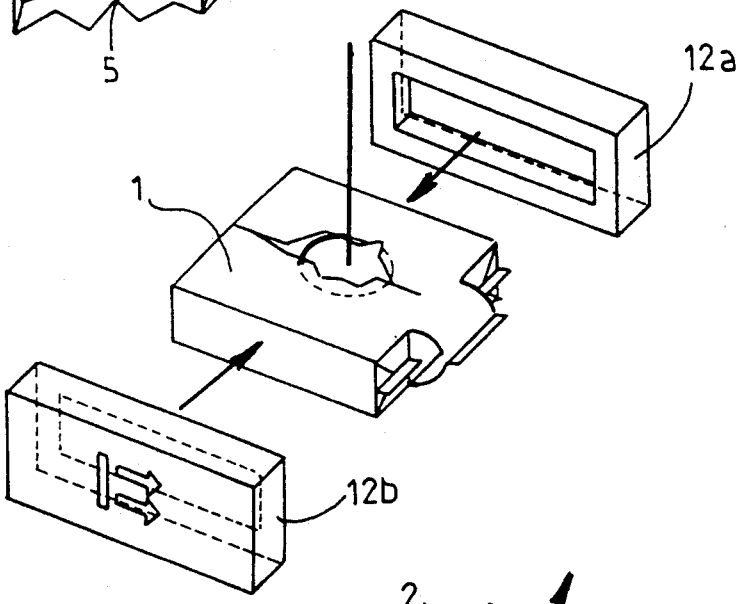
Figure 4D:
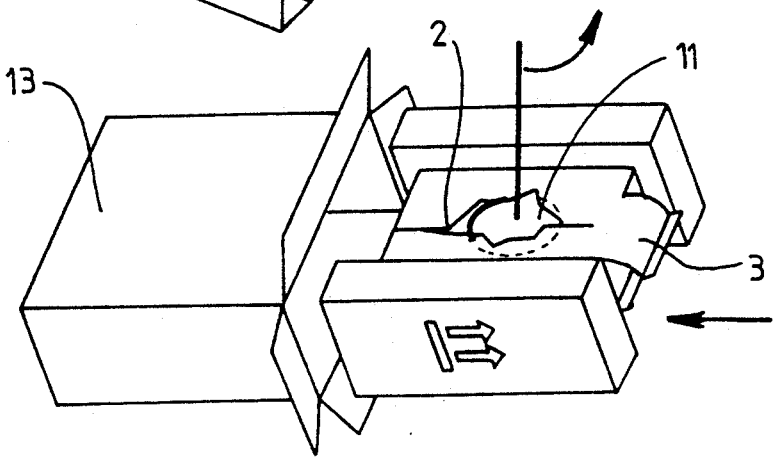

In FIG. 4C, the wrapper 1 is now completely closed around the product. The wedging system, for example consisting of two polystyrene half-shells 12A and 12B, is then placed on the wrapped product. During this stage, the wrapped product, in conjunction with the wedging system, is inserted into a packing box, for example a cardboard carton 13, with wrapper gripping means 3 being oriented so as to be located beside the opening in the wrapper at the end of insertion. When the wrapped product, in conjunction with the wedging system is partially inserted into the packing box, the gripping element 11 is then released so that it is free to pass through passage means 2.

Thus, the protective wrapper of the invention considerably facilitates packing and unpacking operations while remaining simple to operate and very low in cost. Moreover, the packaging process using the wrapper of the invention can easily be automated because the wrapper makes it possible to mechanize its installation over the product.

Other modifications and implementations will occur to those skilled in the art without departing from the spirit and the scope of the invention as claimed. Accordingly, the above description is not intended to limit the invention except as indicated in the following claims.

What is claimed is:

1. A protective wrapper for packaging a heavy product wherein the product is held by a gripping element and the product is to be stored in a carton, the wrapper comprising:

a flexible plastic material forming a pocket of essentially rectangular shape having four sides, the pocket being closed on a bottom side and two lateral sides, and having a partially closed top side, wherein said pocket is provided having a passage means that starts at the bottom side, to permit insertion of the product to be packaged into the wrapper while the product is held by the gripping element, and permits release of the gripping element once the wrapper is in place around the product;

wherein the passage means includes a cut made in the wrapper starting at the bottom side of the wrapper and extending through the entire thickness of the wrapper along a plane substantially orthogonal and median to the wrapper bottom side;

wherein the wrapper further includes as an extension of its top side, a gripping means for extracting the product from the carton, and for carrying the product within the protective wrapper in a wrapped condition, said extension having a closed and transverse to said lateral sides and having opposed edges substantially parallel to said lateral sides; and wherein the gripping means includes a stiffened portion that ensures balance distribution of pulling and stretching forces over the total width of the gripping means; and wherein the stiffened portions is provided by welding said extension of the wrapper along two symmetrical weld line segments, each of such weld line segments having an origin located at each opposed edge of the extension and each weld line segment having an end at a common point located on the median axis of the extension.

2. A protective wrapper for packaging a heavy product wherein the product is held by a gripping element and the product is to be stored in a carton, the wrapper comprising:

a flexible plastic material forming a pocket of essentially rectangular shape having four sides, the pocket being closed on a bottom side and two lateral sides, and having a partially closed top side, wherein said pocket is provided having a passage means that starts at the bottom side, to permit insertion of the product to be packaged into the wrapper while the product is held by the gripping element, and permits release of the gripping element once the wrapper is in place around the product;

wherein the passage means includes a cut made in the wrapper starting at the bottom side of the wrapper and extending through the entire thickness of the wrapper along a plane substantially orthogonal and median to the wrapper bottom side;

wherein the wrapper further includes as an extension of its top side, a gripping means for extracting the product from the carton, and for carrying the product within the protective wrapper in a wrapped condition, said extension having a closed and transverse to said lateral sides and having opposed edges substantially parallel to said lateral sides; and wherein two short cuts are made in the extension of the wrapper, said cuts being coextensive with the opposed edges of the extension and in a direction toward the inside of the protective wrapper.

3. The protective wrapper for packaging a heavy product of claim 8 wherein the wrapper mass-produced as on of a sequence of wrappers, and wherein the gripping means of each wrapper is provided from the bottom side of the previous wrapper in the sequence.

* * * * *

UNITED STATES PATENT AND TRADEMARK OFFICE

CERTIFICATE OF CORRECTION

PATENT NO. : 5,232,148

DATED : August 3, 1993

INVENTOR(S) : Jean-Claude Vilas-Boas

It is certified that error appears in the above-indentified patent and that said Letters Patent is hereby corrected as shown below:

Column 6, line 28, "claim 8" should read --claim 2--.

Signed and Sealed this

Fifth Day of July, 1994

Bruce Lehman

*Attest:*

BRUCE LEHMAN

*Attesting Officer*

*Commissioner of Patents and Trademarks*